US011471925B2

(12) United States Patent
Garimella et al.

(10) Patent No.: US 11,471,925 B2
(45) Date of Patent: Oct. 18, 2022

(54) ALUMINUM WARM FORMING MULTI-OPENING OVEN AND PRODUCTION LINE

(71) Applicants: Venugopal Garimella, Commerce Township, MI (US); Darren Womack, Windsor (CA); Erryn Ashmore, Berkley, MI (US); Tom Sanor, Birmingham, AL (US); Edward Schleichert, Munich (DE); Tarlok Singh Kainth, Belle River (CA); Tracy Arnold Grant Taylor, Windsor (CA); James Arminski, Troy, MI (US); Kevin VanDenBrouck, Troy, MI (US)

(72) Inventors: Venugopal Garimella, Commerce Township, MI (US); Darren Womack, Windsor (CA); Erryn Ashmore, Berkley, MI (US); Tom Sanor, Birmingham, AL (US); Edward Schleichert, Munich (DE); Tarlok Singh Kainth, Belle River (CA); Tracy Arnold Grant Taylor, Windsor (CA); James Arminski, Troy, MI (US); Kevin VanDenBrouck, Troy, MI (US)

(73) Assignee: MAGNA INTERNATIONAL INC., Aurora (CA)

( * ) Notice: Subject to any disclaimer, the term of this patent is extended or adjusted under 35 U.S.C. 154(b) by 1340 days.

(21) Appl. No.: 15/097,320

(22) Filed: Apr. 13, 2016

(65) Prior Publication Data

US 2017/0008060 A1 Jan. 12, 2017

Related U.S. Application Data

(60) Provisional application No. 62/147,721, filed on Apr. 15, 2015.

(51) Int. Cl.
*F27B 3/04* (2006.01)
*B21D 22/02* (2006.01)
(Continued)

(52) U.S. Cl.
CPC ..... *B21D 22/022* (2013.01); *C21D 9/0018* (2013.01); *C21D 9/0068* (2013.01);
(Continued)

(58) Field of Classification Search
IPC ..... F27B 3/04,3/045, 13/02
See application file for complete search history.

(56) References Cited

U.S. PATENT DOCUMENTS 3,638,559 A 2/1972 Parker
4,863,552 A 9/1989 Ishida et al.
(Continued)

OTHER PUBLICATIONS

International Search Report and Written Opinion regarding PCT/US2015/0258910 dated Jul. 10, 2015.

*Primary Examiner* — Lois L Zheng
(74) *Attorney, Agent, or Firm* — Dickinson Wright PLLC

(57) ABSTRACT

A multi-opening oven assembly for simultaneously heating a plurality of blanks, for example aluminum blanks, before forming the heated blanks in a production line is provided. The oven assembly includes vertically aligned shelves to present a plurality of chambers for heating the blanks. A table including an entry side platform and an exit side platform moves vertically along the oven assembly. A rail system extends along the platforms and the shelves to convey the blanks in and out of the chambers. Once one set of heated blanks is removed from a first chamber, the table moves vertically to a second chamber and is ready to receive the next set of heated blanks. A continuous supply of heated blanks is provided for high throughput. The oven assembly is preferably disposed in a press adjacent a forming station
(Continued)

of an existing production line and thus, no additional floor space is required.

6 Claims, 6 Drawing Sheets

(51) Int. Cl.

| | |
|---|---|
| ***C22F 1/04*** | (2006.01) |
| ***F27B 9/02*** | (2006.01) |
| ***C21D 9/00*** | (2006.01) |
| ***F27B 9/30*** | (2006.01) |
| ***F27B 9/24*** | (2006.01) |
| ***F27D 3/00*** | (2006.01) |
| ***F27D 5/00*** | (2006.01) |
| ***F27D 13/00*** | (2006.01) |
| ***F27D 15/00*** | (2006.01) |
| *F27B 1/02* | (2006.01) |

(52) U.S. Cl.
CPC ..... *C22F 1/04* (2013.01); *F27B 9/024* (2013.01); *F27B 9/24* (2013.01); *F27B 9/30* (2013.01); *F27D 3/0024* (2013.01); *F27D 5/00* (2013.01); *F27D 13/00* (2013.01); *F27D 15/00* (2013.01)

(56) References Cited

U.S. PATENT DOCUMENTS

| | | | | |
|---|---|---|---|---|
| 2007/0257407 | A1 | 11/2007 | Danger | |
| 2012/0073108 | A1 | 3/2012 | McNally | |
| 2013/0273486 | A1 | 10/2013 | Dvorak et al. | |
| 2014/0144198 | A1 | 5/2014 | Potocki et al. | |
| 2014/0193762 | A1* | 7/2014 | Grenier | F27B 3/20 432/128 |
| 2017/0045297 | A1* | 2/2017 | Womack | F27B 9/025 |

* cited by examiner

ALUMINUM WARM FORMING MULTI-OPENING OVEN AND PRODUCTION LINE

CROSS REFERENCE TO RELATED APPLICATIONS

This U.S. Patent Application claims the benefit of U.S. Provisional Patent Application Ser. No. 62/147,721 filed on Apr. 15, 2015 entitled "Aluminum Warm Forming Multi-Opening Oven And Production Line," the entire disclosure of the application being considered part of the disclosure of this application and hereby incorporated by reference.

BACKGROUND OF THE INVENTION

1. Field of the Invention

The invention relates generally to oven assemblies and methods for providing a plurality of heated blanks, including methods and assemblies used to warm or hot form aluminum parts in a production line.

2. Related Art

Warm or hot forming is oftentimes used to manufacture aluminum parts for automotive vehicles, such as structural body or chassis components. The process typically includes heating an aluminum blank in an oven, and then transferring the heated blank to one or more forming stations in a production line, for example a stamping or press line, to form the blank into a part having a desired shape. Warm forming typically occurs while the aluminum blank is at temperatures of 150 to 400° C., and hot forming typically occurs at temperatures greater than 400° C.

Disposing an oven or other heating device in an existing production line is oftentimes challenging due to limited space. It is especially challenging to maintain the required throughputs when the production line is used for both room temperature forming and warm forming. Oftentimes, the oven used for warm forming is placed next to the production line. In this case, transferring the heated blanks from the oven to the production line increases the cycle time and causes an undesirable loss in thermal energy. The oven also takes up limited floor space and is difficult to move to a different production line, if the need arises. Thus, in some cases, warm or hot forming in a production line may not be a viable option.

SUMMARY OF THE INVENTION

The invention provides a multi-opening oven assembly for simultaneously heating a plurality of blanks, for example prior to warm or hot forming aluminum blanks in a production line. The multi-opening oven assembly includes shelves aligned vertically relative to one another to provide a plurality of chambers for heating the blanks. An entry side opening is located along one side of each chamber, and an exit side opening is located on the opposite side of each chamber. A table with a rail system moves vertically along the shelves for conveying the blanks in and out of the chambers. The table includes an entry side platform for feeding the blanks into the adjacent chamber and an exit side platform for receiving the blanks once they exit the chamber. The invention also provides a production line including the multi-opening oven assembly.

The invention further provides a method for simultaneously heating a plurality of blanks using the multi-opening oven assembly. The method includes disposing at least one blank on the rail system of the entry side platform to convey the at least one blank into a first one of the chambers, and heating the at least one blank in the first chamber. The method then includes moving the table vertically along the shelves to align the table with a second one of the chambers, and disposing at least blank on the rail system of the entry side platform to convey the at least one blank into the second chamber while heating the at least one blank in the first chamber. The method further includes moving the table vertically back to the first chamber to receive the at least one heated blank after the heating step is complete.

The multi-opening oven assembly of the present invention provides numerous advantages, especially when used in an existing production line, for example to warm form aluminum parts. First, due to the number of chambers, the multi-opening oven assembly simultaneously heats numerous blanks from room temperature to an appropriate operating temperature, and thus can continuously provide heated blanks which can be immediately transferred to a forming station. The multi-opening oven assembly is preferably disposed in an existing production line, so that the heated blanks can be quickly transferred from the exit side platform to the first forming station, which decreases the cycle time of the process, energy loss, and other costs associated with transferring the blanks. The continuous supply of heated blanks in the production line provides a high throughput process. The blanks can also be heated to different temperatures and/or for different durations of time in the multi-opening oven by using the numerous chambers. The multi-opening oven assembly is preferably disposed inside of a press of the existing production line to provide a compact design, so that no additional floor space is required. If needed, the multi-opening oven assembly can also be quickly and easily moved to another production line using a rolling bolster. The multi-opening oven assembly can be designed to work with de-stacking units, robots, lubrication systems, automation, and other features of exiting production lines. The table and rail system can also be designed to automatically self-feed the blanks into the chambers.

BRIEF DESCRIPTION OF THE DRAWINGS

Other advantages of the present invention will be readily appreciated, as the same becomes better understood by reference to the following detailed description when considered in connection with the accompanying drawings wherein.

DESCRIPTION OF THE ENABLING EMBODIMENT

The invention provides a multi-window oven assembly 20 for simultaneously heating a plurality of metal blanks in a production line, as shown in FIGS. 1-5. The multi-window oven assembly 20 is typically used to heat a plurality of aluminum blanks prior to warm or hot stamping, but the oven assembly 20 can alternatively be used for other types of metal forming processes. In one embodiment, the aluminum blanks are formed of a 5xxx series aluminum alloy, but other alloys could be used.

Figure 1A:
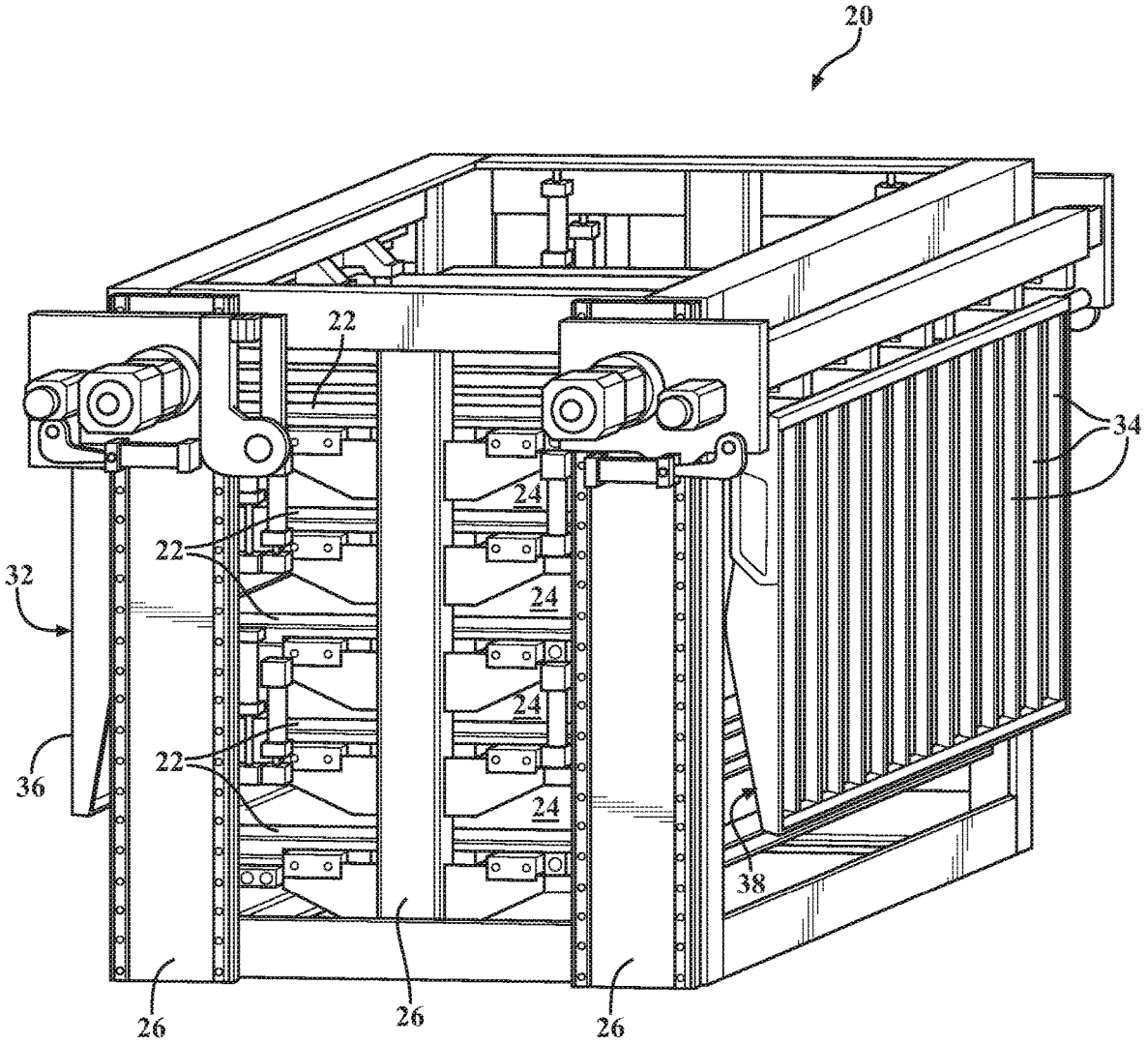
FIG. 1A is a perspective view of a multi-opening oven assembly during pre-heating according to an example embodiment of the invention.

As best shown in FIG. 1A, the multi-window oven assembly 20 includes a plurality of shelves 22 extending horizontally relative to the ground. The shelves 22 are aligned and stacked vertically relative to one another and are spaced from one another to provide a plurality of vertically aligned heating chambers 24. The number of shelves 22 and chambers 24 can be adjusted depending on the desired output. In the example embodiments, the shelves 22 are rectangular in shape and are coupled to one another by a plurality of beams 26 extending longitudinally along the ends of the shelves 22. Preferable, each shelf 22 is insulated to reduce energy loss. The shelves 22 are typically insulated along each surface, except for the surface directly exposed to the blanks, to direct the heat towards the blanks. The insulation can be provided by a coating or a separate piece attached to the shelf 22.

Figure 1B:
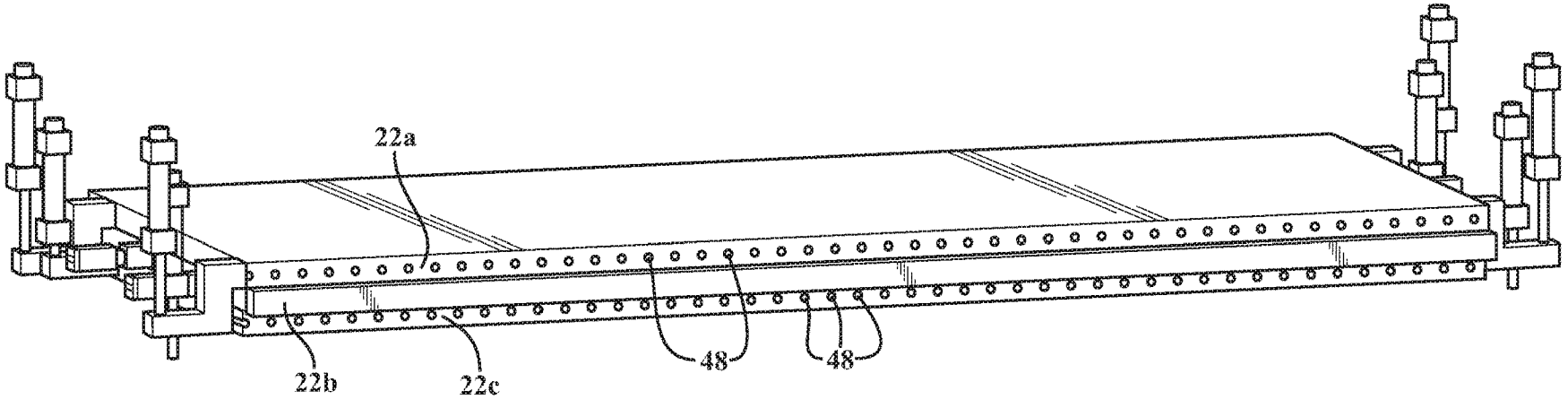
FIG. 1B is a perspective view of a shelf of the multi-opening oven assembly of FIG. 1A including an upper platen, a middle platen, and a lower platen while the blanks are being heated.
Figure 1C:
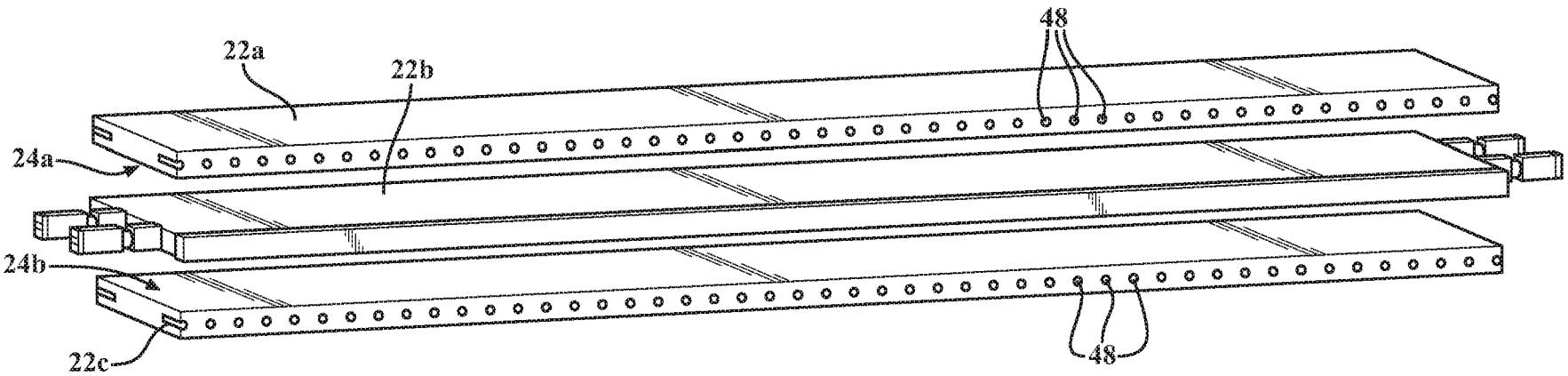
FIG. 1C is a perspective view of the shelf of the multi-opening oven assembly of FIG. 1A in an open position wherein the platens present a pair of chambers for receiving the blanks.
Figure 2:
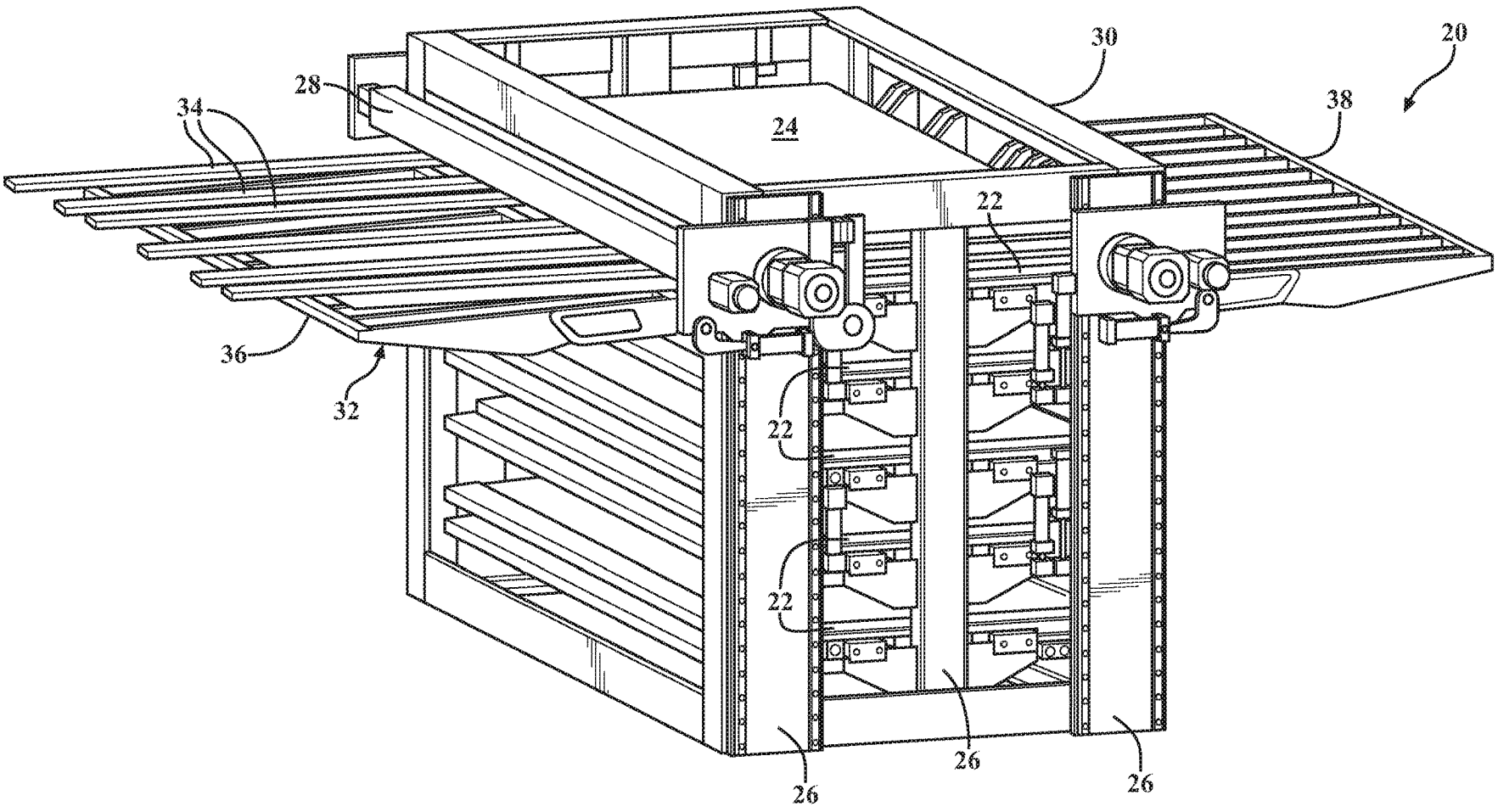
FIG. 2 is a perspective view of the multi-opening oven assembly of FIG. 1 during operation.

As best shown in FIGS. 1B and 1C, in the example embodiment, each shelf 22 includes an upper platen 22*a*, a middle platen 22*b*, and a lower platen 22*c*. The middle platen 22*b* remains fixed while the upper platen 22*a* and lower platen 22*c* move vertically relative to the middle platen 22*b* to provide a pair of chambers 24*a*, 24*b* therebetween. FIG. 1B shows the platens 22*a*, 22*b*, 22*c* in a closed position while one blank is heated between the upper platen 22*a* and the middle platen 22*b*, and another blank is heated between the middle platen 22*b* and the lower platen 22*c*. The blanks rest on the upper surface of the lower platen 22*c* and the upper surface of the middle platen 22*b* during the heating step. FIG. 1C shows the platens 22*a*, 22*b*, 22*c* in an open position to present the pair of chambers 24*a*, 24*b* which are ready to receive at least one blank or allow at least one blank to exit the chambers 24*a*, 24*b*. The upper platen 22*a* moves vertically upward and away from the middle platen 22*b* to present one open chamber 24*a*, and the lower platen 22*c* moves vertically downward away from the middle platen 22*b* to present another open chamber 22*b*. Preferably, each platen 22*a*, 22*b*, 22*c* is insulated along each surface, except for the surface directly exposed to the blanks, to direct the heat towards the blanks.

The multi-window oven assembly 20 includes a plurality of openings 28, 30 for access to the chambers 24. Each chamber 24 includes an entry side opening 28 located along one side of the assembly 20 and an exit side opening 30 located on the opposite side of the assembly 20.

The multi-window oven assembly 20 also includes a table 32 with a conveyor, such as a rail system for conveying unheated blanks to the chambers 24 and transferring heated blanks out of the chambers 24. In the example embodiments, the table 32 includes an entry side platform 36 for feeding the unheated blanks into one adjacent chamber 24 and an exit side platform 38 for receiving and holding the blanks once they exit the adjacent chamber 24. The platforms 36, 38 each present a rectangular shape and are disposed parallel to the shelves 22 during operation.

The rail system of the example embodiments includes a plurality of tracks 34 disposed parallel to one another. The tracks 34 extend along the entry side platform 36, along the shelves 22 of the chambers 24, and along the exit side platform 38. Each shelf 22 and each platform 36, 38 include the plurality of tracks 34. In the example embodiment, wherein each shelf 22 presents a pair of chambers 24*a*, 24*b*, only the middle platen 22*b* and the lower platen 22*c* include the tracks 34. The rail system is designed to automatically or self-feed the unheated blanks into the chambers 24 and convey the heated blanks out of the chambers 24. Robots 40 are typically used to place the unheated blanks on the entry side platform 36 and remove the heated blanks from the exit side platform 38.

The platforms 36, 38 can pivot and rest against the shelves 22, for example when the oven assembly 20 is in storage, or during a pre-heating step, as shown in FIG. 1A. After the pre-heating step, the platforms 36, 38 pivot relative to the shelves 22 so that they are disposed parallel to the shelves 22 during operation. During operation, the table 32 moves vertically along the shelves 22 to convey the blanks to and from the chambers 24. At the start of the process, at least one unheated blank is fed onto the rail system of the entry side platform 36 and into one of the chambers 24. When at least one heated blank is ready for removal from one of the chambers 24, the table 32 moves vertically into alignment with that chamber 24. The at least one heated blank is first removed through the exit side opening 30 of the chamber 24, and then at least one unheated blank is feed through the entry side opening 28 to the open chamber 24.

The location of the table 32 along the multi-opening oven assembly 20 can be automated or controlled manually. The order and timing of feeding the unheated blanks to the chambers 24 and removing the heated blanks from the chambers 24 can be adjusted as desired, depending on the desired heating times, temperatures, and number of blanks needed during operation. The moving table 32 works with the multiple chambers 24 to continuously supply heated blanks and achieve a high throughput process.

The multi-window oven assembly 20 also includes at least one heating device for heating the blanks, for example one heating device located in each of the chambers 24. Any type of heating device can be incorporated into the multi-window oven assembly 20. The heating devices can be used to heat the chambers 24 to different temperatures, or for different durations of time, if desired. In the example embodiment, the heating device is provided by a plurality of heating tubes 48 which extend through each of the platens 22*a*, 22*b*, 22*c*.

In an example embodiment shown in FIG. 1A, wherein the oven assembly 20 includes five shelves 22 and ten chambers 24, the method of providing the heated blanks includes aligning the table 32 with a first one of the chambers 24*a*, feeding a first set of unheated blanks into the first chamber 24*a*, moving the table 32 vertically to align with a second one of the chambers 24*b*, feeding a second set of unheated blanks into the second chamber 24*b*, moving the table 32 vertically to align with a third one of the chambers 24*a*, feeding a third set of unheated blanks into the third chamber 24*a*, moving the table 32 vertically to align with a fourth one of the chambers 24*b*, feeding a fourth set of unheated blanks into the fourth chamber 24*b*, moving the table 32 vertically to align with a fifth one of the chambers 24*a*, feeding a fifth set of unheated blanks into the fifth chamber 24*a*, etc. until the desired number of chambers 24*a*, 24*b* are filled with blanks. Once the first set of blanks is finished heating, the method includes moving the table 32 back into vertical alignment with the first chamber 24*a*, conveying the first set of heated blanks out of the first chamber 24*a*, and feeding another set of unheated blanks into the open first chamber 24*a*. The first set of heated blanks is immediately removed from the exit side platform 38 and transferred to an adjacent forming station. As soon as the first set of heated blanks is removed from the exit side platform 38, the method includes moving the table 32 vertically into alignment with the second chamber 24*b*. Once the table 32 arrives at the second chamber 24*b*, the second set of blanks should be finished heating, and thus the method includes conveying the second set of heated blanks out of the second chamber 24*b*, and feeding another set of unheated blanks into the open second chamber 24*b*. The second set of heated blanks is immediately removed from the exit side platform 38 and transferred to the adjacent forming station. The table 32 then moves to the third chamber 24*a*, and the previously recited steps are repeated continuously to provide the necessary amount of heated blanks at the appropriate times.

Figure 3B:
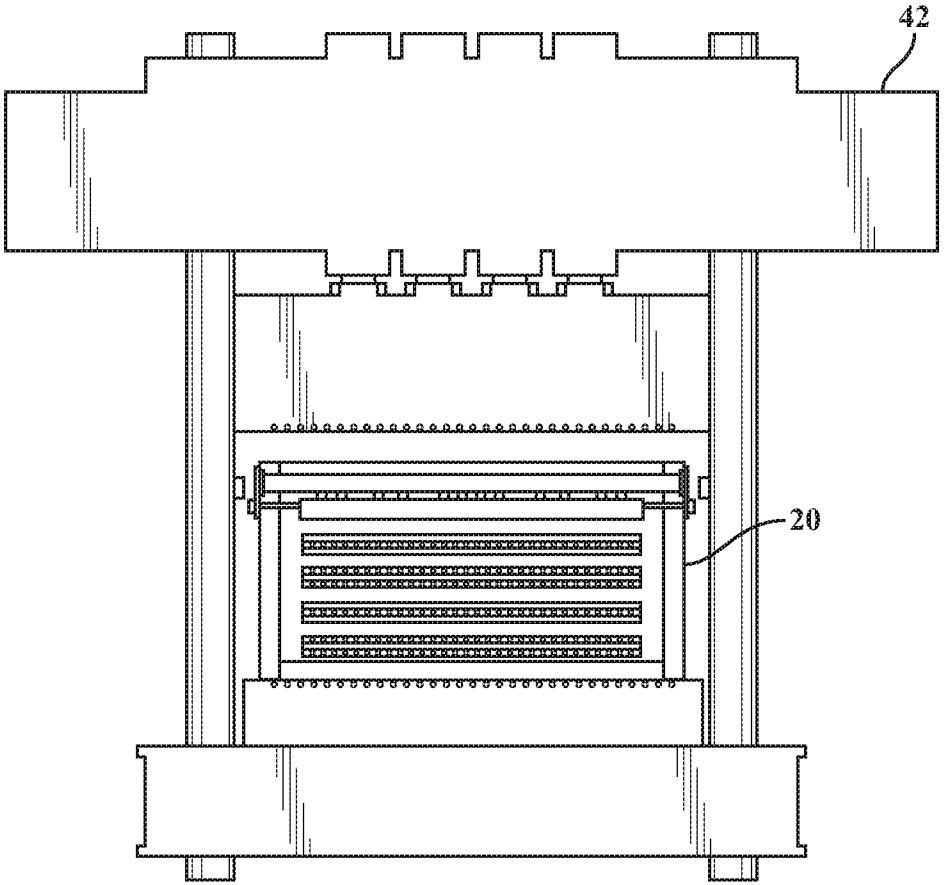
FIG. 3B includes a second side view of the multi-opening oven assembly disposed in the press according to the second example embodiment.
Figure 3A:
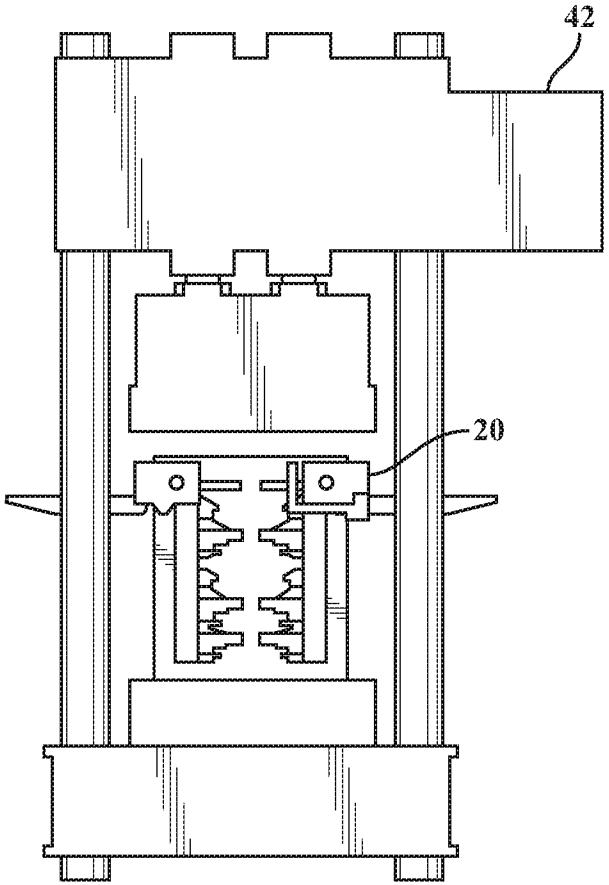
FIG. 3A includes a first side view of the multi-opening oven assembly disposed in a press according to a second example embodiment.
Figure 5:
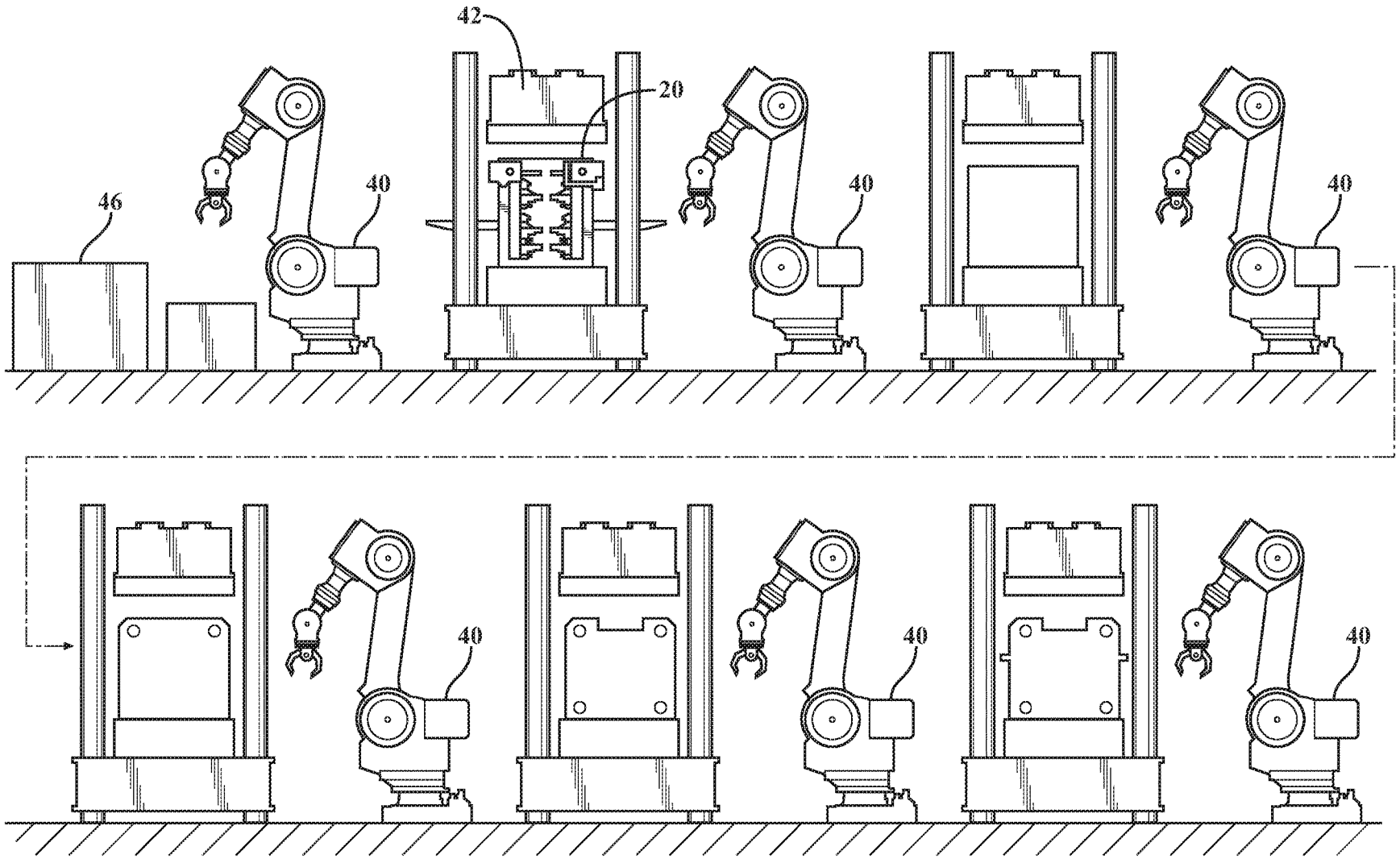
FIG. 5 is a side view of the multi-opening oven assembly disposed in a press of a stamping line according to a fourth example embodiment.

As shown in the example embodiments of FIGS. 3A, 3B, and 5, the multi-opening oven assembly 20 is preferably disposed in a press 42 of an existing production line. Thus, once the heated blanks exit the chambers 24, they can be quickly transferred to the adjacent forming stations. In addition, disposing the multi-opening oven assembly 20 in the press 42 provides a compact design, so that no additional floor space is required. The multi-opening oven assembly 20 can also be designed to work with de-stacking units, robots, lubrication systems, automation, and other features of exiting production lines.

Figure 4:
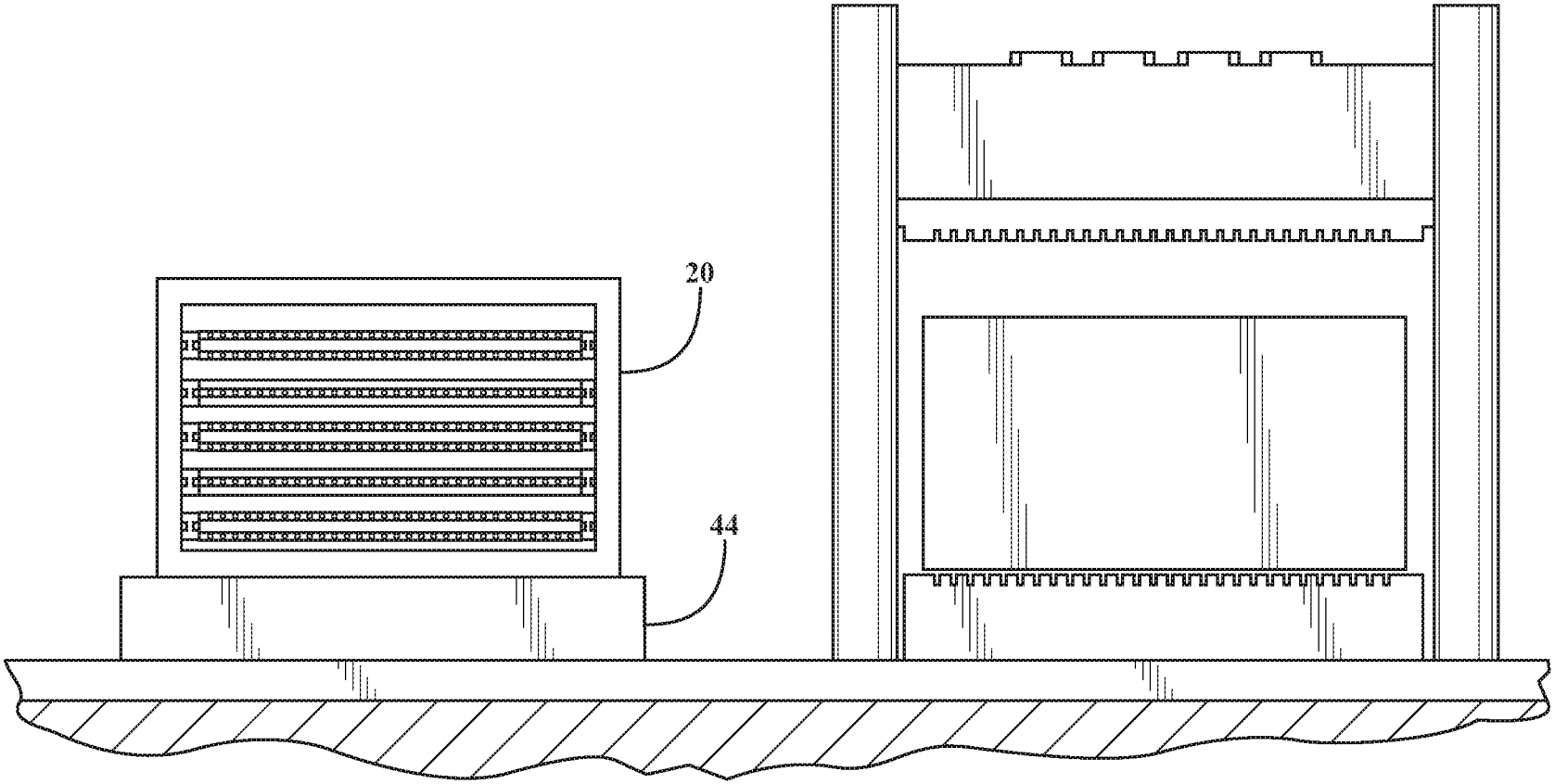
FIG. 4 is a side view of the multi-opening oven assembly on a rolling bolster during a pre-heating step according to a third example embodiment.

As shown in FIG. 4, prior to the warm or hot forming process, the multi-window oven assembly 20 is typically preheated on a rolling bolster 44. For example, if the production line is used for cold and hot stamping processes, the multi-window oven assembly 20 can be pre-heated during the cold stamping process and then transferred to into the press 42 for a hot stamping process. By placing the multi-window oven assembly 20 on the rolling bolster 44, the multi-opening oven assembly 20 can be quickly and easily moved in and out of the production line, or transferred to another production line, if needed.

FIG. 5 shows the multi-window oven assembly 20 in a press 42 of an existing production line according to an example embodiment. The production line first includes a lube station 46 where lubricant is applied to the unheated blanks. A first robot 40 transfers the unheated blanks from the lube station 46 to the entry side platform 36 of the multi-window oven assembly 20. The rail system automatically conveys the unheated blanks through the entry side opening 28 and into the adjacent chamber 24 for heating. After the blank is heated, the rail system transfers the heated blanks through the exit side opening 30 to the exit side platform 38. A second robot 40 then transfers the heated blank from the exit side platform 38 to an adjacent press in the production line for a drawing step. After the drawing step, the blanks are transferred by robots 40 to two consecutive presses for trimming and piercing, and then to a fifth press for piercing, flanging, and re-striking. It is noted that the production line including the multi-window oven assembly 20 can include various other forming stations in addition to, or instead of, the stations shown in FIG. 5.

Many modifications and variations of the present invention are possible in light of the above teachings and may be practiced otherwise than as specifically described while within the scope of the invention.

The invention claimed is:

1. A method of heating a plurality of blanks in a production line using an oven assembly, the oven assembly including a plurality of vertically aligned shelves providing a plurality of vertically aligned chambers, and comprising the steps of:

conveying at least one first blank from an entry side platform to a first chamber of the oven assembly;

heating the at least one first blank in the first chamber;

moving the entry side platform vertically to a second chamber of the oven assembly while heating the at least one first blank;

conveying at least one second blank from the entry side platform to the second chamber while heating the at least one first blank;

heating the at least one second blank in the second chamber;

conveying the at least one first blank from the first chamber to an exit side platform while heating the at least one second blank in the second chamber;

moving the entry side platform vertically to the first chamber and conveying at least one third blank from the entry side platform to the first chamber during or after conveying the at least one first blank to the exit side platform;

moving the exit side platform vertically to the second chamber and conveying the at least one second blank from the second chamber to the exit side platform while heating the at least one third blank; and the entry side platform and the exit side platform moving simultaneously, and wherein at least one of the shelves includes an upper platen, a lower platen, and a middle platen disposed between the upper platen and the lower platen, and the platens are spaced from one another to provide a pair of the chambers.

2. The method of claim 1, wherein the step of conveying the at least one third blank to the first chamber occurs while heating the at least one second blank.

3. The method of claim 1 including disposing the oven assembly on a rolling bolster, and moving the oven assembly on the rolling bolster to or away from the press of the production line.

4. The method of claim 3 including preheating the oven assembly before moving the oven assembly on the rolling bolster to the press.

5. The method of claim 1, wherein the middle platen is disposed in a fixed vertical position, and the upper platen and the lower platen are movable vertically.

6. The method of claim 1 including tracks extending along the entry side platform, the middle platen, the lower platen, and the exit side platform for conveying the blanks.

* * * * *